US010978224B2

(12) United States Patent
Yamazaki et al.

(10) Patent No.: US 10,978,224 B2
(45) Date of Patent: Apr. 13, 2021

(54) TWISTED WIRE AND MANUFACTURING METHOD THEREOF

(71) Applicant: DAIKIN INDUSTRIES, LTD., Osaka (JP)

(72) Inventors: Keiko Yamazaki, Osaka (JP); Tadaharu Isaka, Osaka (JP); Masahiro Kondo, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 175 days.

(21) Appl. No.: 16/389,507

(22) Filed: Apr. 19, 2019

(65) Prior Publication Data

US 2019/0333658 A1 Oct. 31, 2019

(30) Foreign Application Priority Data

Apr. 25, 2018 (JP) ..... JP2018-084493
May 31, 2018 (JP) ..... JP2018-104316
Jan. 17, 2019 (JP) ..... JP2019-005738

(51) Int. Cl.
*H01B 13/00* (2006.01)
*H01B 13/14* (2006.01)
*H01B 7/02* (2006.01)

(52) U.S. Cl.
CPC ..... *H01B 13/0003* (2013.01); *H01B 7/0275* (2013.01); *H01B 13/0036* (2013.01); *H01B 13/14* (2013.01)

(58) Field of Classification Search
CPC ..... H01B 13/0003; H01B 13/0036; H01B 13/14; H01B 7/02; H01B 7/0275
See application file for complete search history.

(56) References Cited

U.S. PATENT DOCUMENTS 3,328,514 A * 6/1967 Cogelia ..... H01B 7/288 174/113 R
4,935,467 A * 6/1990 Cheng ..... C08L 23/08 252/511
5,286,923 A * 2/1994 Prudhon ..... H01B 7/0233 174/107
5,483,020 A * 1/1996 Hardie ..... H01B 11/203 156/51

(Continued)

FOREIGN PATENT DOCUMENTS

JP 2011-514649 A 5/2011
JP 2016-004707 A 1/2016

OTHER PUBLICATIONS

International Search Report dated Jul. 16, 2019 issued by the International Searching Authority in International Application No. PCT/JP2019/016717.

(Continued)

*Primary Examiner* — Timothy J Thompson
*Assistant Examiner* — Rhadames Alonzo Miller
(74) *Attorney, Agent, or Firm* — Sughrue Mion, PLLC

(57) ABSTRACT

Provided is a twisted wire including a plurality of covered wires twisted together, each covered wire including a conductor and an insulator covering the periphery of the conductor, wherein the twisted wire satisfies Inequality (1): $y<A\times x/(z/500)+B$ (wherein x: a pitch length (mm) of the twisted wire, y: a collapsing rate (%) of the insulator, z: an elastic modulus (MPa) of the insulator, A: Constant A=−1, and B: Constant B=11.5).

15 Claims, 5 Drawing Sheets

(56) References Cited

U.S. PATENT DOCUMENTS 5,956,445 A * 9/1999 Deitz, Sr. ..... G02B 6/441 174/24
6,010,788 A * 1/2000 Kebabjian ..... H01B 11/002 174/102 R
6,403,887 B1 * 6/2002 Kebabjian ..... H01B 11/002 174/110 R
6,677,518 B2 * 1/2004 Hirakawa ..... H01B 11/002 174/36
9,349,508 B2 * 5/2016 Nonen ..... H01B 11/20
9,508,467 B2 * 11/2016 Pon ..... H01B 9/003
10,008,307 B1 * 6/2018 Lanoe ..... H01B 11/08
10,665,365 B2 * 5/2020 Gatu ..... H01B 13/103
2003/0150633 A1 * 8/2003 Hirakawa ..... H01B 11/1016 174/36
2005/0013573 A1 * 1/2005 Lochkovic ..... G02B 6/4402 385/128
2006/0021772 A1 * 2/2006 Dellagala ..... H01B 11/002 174/27
2006/0048966 A1 * 3/2006 Takahashi ..... H01B 11/1025 174/108
2008/0264671 A1 * 10/2008 Kenny ..... H01B 13/141 174/120 SR
2009/0229851 A1 * 9/2009 Thuot ..... H01B 13/142 174/107
2009/0229852 A1 * 9/2009 Thuot ..... H01B 7/0275 174/113 R
2009/0258024 A1 10/2009 Bukrinsky et al.
2010/0025072 A1 * 2/2010 Okano ..... H01B 11/1008 174/115
2010/0293785 A1 11/2010 Thuot et al.
2011/0075977 A1 * 3/2011 Register, III ..... G02B 6/4432 385/100
2011/0075980 A1 * 3/2011 Register, III ..... G02B 6/4429 385/113
2011/0091173 A1 * 4/2011 Register, III ..... G02B 6/443 385/113
2012/0267159 A1 * 10/2012 Gundel ..... H01B 7/0861 174/350
2013/0333913 A1 * 12/2013 Nonen ..... H01B 11/20 174/34
2014/0182881 A1 * 7/2014 Huang ..... H01B 11/1091 174/103
2014/0262424 A1 * 9/2014 Liptak ..... H01B 11/1091 174/106 R
2015/0000954 A1 * 1/2015 Nonen ..... H01B 11/20 174/103
2015/0086168 A1 * 3/2015 Blazer ..... G02B 6/4413 385/102
2015/0153531 A1 * 6/2015 McAlpine ..... G02B 6/4434 385/102
2015/0177471 A1 * 6/2015 Bringuier ..... G02B 6/4494 385/103
2015/0277075 A1 * 10/2015 Abernathy ..... G02B 6/4402 385/101
2016/0078981 A1 * 3/2016 Kumada ..... H01B 9/003 174/72 A
2016/0225488 A1 * 8/2016 Pon ..... H01B 9/003
2016/0299306 A1 * 10/2016 McAlpine ..... G02B 6/443
2016/0306128 A1 * 10/2016 Chiasson ..... G02B 6/443
2016/0306129 A1 * 10/2016 Hurley ..... G02B 6/4433
2016/0306130 A1 * 10/2016 Bringuier ..... G02B 6/4433
2017/0355883 A1 * 12/2017 Hayakawa ..... B60R 16/0207
2019/0221332 A1 * 7/2019 Grant ..... H01B 11/1817
2019/0248308 A1 * 8/2019 Hayakawa ..... B60R 16/0215
2020/0012061 A1 * 1/2020 Kmiec ..... G02B 6/02033
2020/0168366 A1 * 5/2020 Uegaki ..... H01B 11/1008

OTHER PUBLICATIONS

Translation of International Preliminary Report on Patentability dated Oct. 27, 2020 with translation of the Written Opinion from the International Bureau in International Application No. PCT/JP2019/016717.

* cited by examiner

TWISTED WIRE AND MANUFACTURING METHOD THEREOF

TECHNICAL FIELD

The present disclosure relates to a twisted wire and a manufacturing method thereof.

BACKGROUND ART

Twisted wires which are less affected by noises have been conventionally used as communication cables.

For example, National Publication of International Patent Application No. 2011-514649 proposes a pair of conductors each having polymer insulation thereon, the polymer insulation on each of said conductors having an exterior surface comprising: peaks and valleys alternating longitudinally along said exterior surface, said pair of conductors each having said polymer insulation thereon being twisted together to form a twisted pair wherein at least one of said peaks in the exterior surface of said polymer insulation on one of said conductors is nested in one of said valleys in the exterior surface of said polymer insulation on the other of said conductors to provide an improved impedance efficiency as compared to polymer insulation of the same weight but of uniform thickness.

SUMMARY

According to the present disclosure, provided is a twisted wire comprising a plurality of covered wires twisted together, each covered wire including a conductor and an insulator covering the periphery of the conductor, wherein the twisted wire satisfies following Inequality (1):

[Expression 1]

$$y < A \times \frac{x}{z \div 500} + B \quad (1)$$

wherein x: a pitch length (m) of the twisted wire, y: a collapsing rate (%) of the insulator, z: an elastic modulus (MPa) of the insulator, A: Constant A=−1, and B: Constant B=11.5.

DESCRIPTION OF EMBODIMENTS

Figure 1:
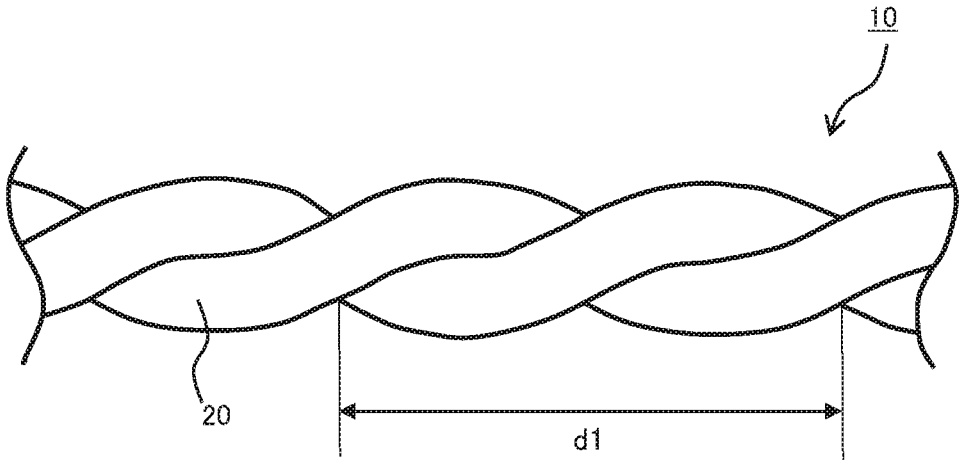
FIG. 1 is a plan view of a twisted wire according to one embodiment of the present disclosure.

Hereinbelow, specific embodiments of the present disclosure will be described in detail, but the present disclosure is not limited to the following embodiments.

In a conventional manufacturing method of a twisted wire, there is a problem that the shorter the pitch length of twisting becomes, the easier the insulator is collapsed. Accordingly, an insulator for a twisted wire obtained by the conventional manufacturing method is required to be thickened by increasing an amount of polymer material for forming the insulator to compensate reduction in a characteristic impedance due to collapse.

The present disclosure aims at providing a lighter twisted wire compared to a conventional twisted wire with the same pitch length and characteristic impedance, and a method for manufacturing a light twisted wire.

That is, according to the present disclosure, a lighter twisted wire compared to a conventional twisted wire with the same pitch length and characteristic impedance, and a method for manufacturing a light twisted wire can be provided.

(Twisted Wire)

A twisted wire of the present disclosure is a twisted wire including a plurality of covered wires twisted together, each covered wire including a conductor and an insulator covering the periphery of the conductor, wherein the twisted wire satisfies following Inequality (1):

[Expression 2]

$$y < A \times \frac{x}{z \div 500} + B \quad (1)$$

wherein x: a pitch length (m) of the twisted wire, y: a collapsing rate (%) of the insulator, z: an elastic modulus (MPa) of the insulator, A: Constant A=−1, and B: Constant B=11.5.

The present inventors have found that the twisted wire in which the collapsing rate of the insulator and the pitch length and elastic modulus of the twisted wire satisfying a certain relationship is lighter than the conventional twisted wire with the same pitch length and characteristic impedance to complete the twisted wire of the present disclosure. According to the present disclosure, a twisted wire having a characteristic impedance not much different than a designed characteristic impedance can be manufactured without forming an insulator having a complex shape as in the technique described in National Publication of International Patent Application No. 2011-514649. In addition, the twisted wire of the present disclosure shows a desired characteristic impedance, is light, and is easily manufactured even when the twisted wire of the present disclosure does not have a complex shape. In addition, since a configuration other than the covered wire such as a spacer is not needed to be provided, there is an advantage of easy terminal processing in addition to an advantage in terms of cost. For example, the designed characteristic impedance of the twisted wire may be 100Ω.

Inequality (1) is experimentally obtained from pitch length and collapsing rate values of several twisted wires. The pitch length and collapsing rate values of the several twisted wires are plotted on a graph in which the horizontal axis represents pitch lengths of the twisted wires and the vertical axis represents collapsing rates of the twisted wires, a straight line marking a range for obtaining a twisted wire which is light and shows a desired characteristic impedance is drawn, and Constant A in the present disclosure is a value obtained from the slope of this line. In addition, Constant B in the present disclosure is a value obtained from the intersection of the line with the vertical axis.

Constant B in Inequality (1) is 11.5, preferably 11.0, and more preferably 10.5. The smaller the Constant B is, the more the weight can be reduced.

FIG. 1 is a plan view of a twisted wire according to one embodiment of the present disclosure. In the twisted wire 10 shown in FIG. 1, two covered wires 20 are twisted together to from the twisted wire. In the present disclosure, the pitch length (mm) of the twisted wire is defined as a length dl per full twist shown in FIG. 1. The pitch length is preferably 4 to 10 mm, more preferably 6 mm or more, more preferably 9 mm or less, and still more preferably 8 mm or less. Even if the pitch length is relatively short as above, the twisted wire of the present disclosure is lighter than the conventional twisted wire showing the same impedance.

Figure 2:
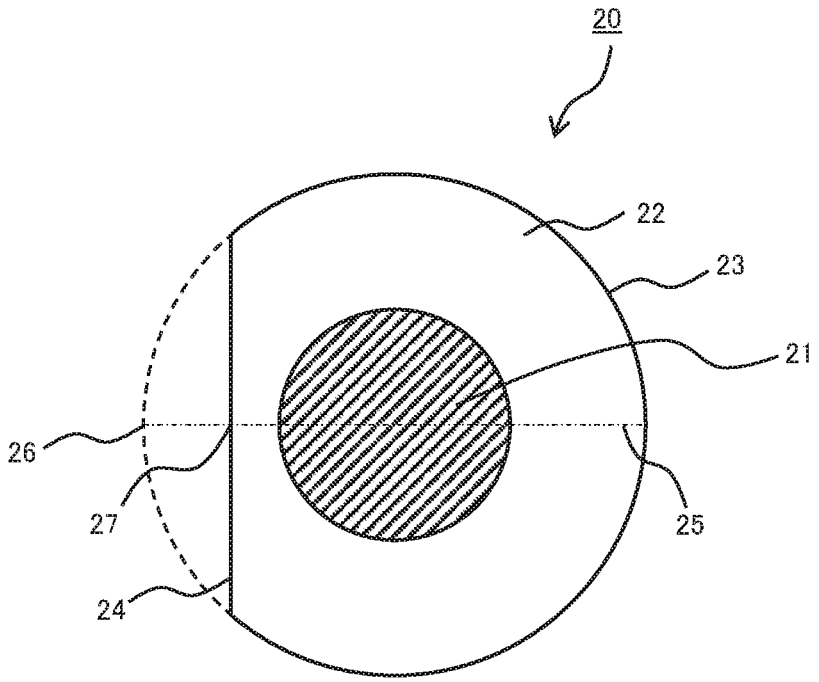
FIG. 2 is a cross-sectional view of one covered wire constituting a twisted wire according to one embodiment of the present disclosure.

FIG. 2 is a cross-sectional view of one covered wire of the two covered wires 20 constituting the twisted wire 10 shown in FIG. 1. The covered wire 20 shown in FIG. 2 includes a conductor 21 and an insulator 22 covering the periphery of the conductor 21, and the insulator 22 has a single layer structure. A part of the insulator 22 is collapsed by twisting the two covered wires 20 together. Accordingly, the cross-sectional shape of the insulator 22 is defined by an external profile 23 and a collapsed face 24 formed by collapse.

The collapsing rate (%) in the present disclosure is a value obtained through the following expression using a distance from the external profile 23 to the collapsed face 24 and a diameter of the external profile in the cross-sectional view of the twisted wire shown in FIG. 2. The distance from the external profile 23 to the collapsed face 24 is a distance from an intersection 26 of the external profile 23 with a diameter line 25 passing through the center of the collapsed face 24 to an intersection 27 of the collapsed face 24 with the diameter line 25 passing through the center of the collapsed face 24.

Collapsing Rate (%)=(Distance from External Profile to Collapsed Face)/(Diameter of External Profile)×100

The collapsing rate is preferably 0 to 6%, and more preferably 0 to 3% in view of allowing a further reduction in weight.

The diameter of the external profile is determined by a diameter of the conductor 21 and a thickness of the insulator 22 included in the covered wire before being twisted. The thickness of the insulator is preferably 0.01 to 3.0 am, more preferably 0.05 of 2.0 mm still more preferably 0.1 to 1.0 mm and especially preferably 0.1 to 0.6 am.

The distance from the external profile 23 to the collapsed face 24 is determined by the collapsing rate and the thickness of the insulator. The pitch length of the twisted wire affects the distance from the external profile 23 to the collapsed face 24, and as the pitch length becomes shorter, the collapsing rate and the distance from the external profile 23 to the collapsed face 24 tend to increase.

In the present disclosure, the elastic modulus (MPa) of the insulator is an elastic modulus measured only on the insulator of the covered wire and is a value measured according to ASTM D638.

The elastic modulus (MPa) of the insulator is determined by an elastic modulus of a material forming the insulator. The elastic modulus of the insulator is preferably 200 to 700 MPa, more preferably 300 MPa or more, still more preferably 400 MPa or more, and more preferably 600 MPa or less. As the elastic modulus becomes higher, the reduction in weight of an insulated wire tends to be easier, and as the elastic modulus becomes lower, manufacturing of the insulated wire tends to be easier.

The twisted wire of the present disclosure preferably satisfies Inequality (2) below in addition to satisfying Inequality (1) above in view of allowing a further reduction in weight and easy manufacturing:

[Expression 3]

$$A \times \frac{x}{z \div 500} + C < y \tag{2}$$

wherein x: a pitch length (m) of the twisted wire, y: a collapsing rate (%) of the insulator, z: an elastic modulus (MPa) of the insulator, A: Constant A=−1, and C: Constant C=0.06.

As in Inequality (1), Inequality (2) is also experimentally obtained from pitch length and collapsing rate values of several twisted wires. In Inequality (2), x, y, z and A are the same as those described above.

Constant C in Inequality (2) is 0.06, preferably 0.07, and more preferably 0.08. A twisted wire with larger Constant C tends to be readily produced.

In the twisted wire of the present disclosure, the cross-sectional shape of the covered wire is preferably approximately circle and more preferably approximately perfect circle. For the twisted wire of the present disclosure, the weight thereof can be reduced without providing an unevenness such as peaks and valleys on an exterior surface of the insulator. In addition, in the twisted wire of the present disclosure, the insulator may be any of a foamed body and a non-foamed body (solid), for example.

The covered wire constituting the twisted wire of the present disclosure includes a conductor. For example, the conductor may be one wire rod, may be a twisted wire in which a plurality of wire rods are twisted together, and may be a compressed conductor obtained by compressing a twisted wire.

Metal conductor materials such as copper and aluminum can be used as a material of the conductor. In addition, a copper material plated with a different metal such as silver, tin or nickel can also be used.

The diameter of the conductor is preferably 0.2 to 3 ram, more preferably 0.25 mm or more, still more preferably 0.28 mm or more, especially preferably 0.32 mm or more, most preferably 0.36 mm or more, more preferably 1.03 mm or less, still more preferably 0.82 mm or less, especially preferably 0.73 mm or less and most preferably 0.65 mm or less.

In addition, as the conductor, a conductor having AWG (American Wire Gauge) ranging from 18 to 30 is preferable, a conductor having AWG ranging from 20 to 29 is more preferable, a conductor having AWG ranging from 21 to 28 is still more preferable and a conductor having AWG ranging from 22 to 27 is especially preferable.

The covered wire constituting the twisted wire of the present disclosure includes an insulator covering the periphery of the conductor.

The insulator can be formed by a polymer. The insulator can include, for example, a fluoropolymer or a non-fluorinated polymer.

As the non-fluorinated polymer, a non-fluorinated thermoplastic polymer is preferable, and examples thereof include a polyolefin; a polyamide; a polyester; a polyaryleneetherketone such as a polyetherketone (PEK), a polyetheretherketone (PEEK) and a polyetherketoneketone (PEKK). Examples of the polyolefin include a polypropylene such as an isotactic polypropylene, and a linear polyethylene such as a high density polyethylene (HDPE) and a linear low density polyethylene (LLDPE). For example, the linear low density polyethylene may be a copolymer of ethylene and an olefin having 4 to 8 carbon atoms such as butene and octene.

As the insulator, an insulator including a fluoropolymer is preferable, an insulator including a fluororesin is more preferable, and an insulator including a melt-fabricable fluororesin is still more preferable, since flame retardancy thereof is excellent, a further reduction in weight is allowed, and other electrical properties thereof are also good. In the present disclosure, the fluororesin is a partial crystalline fluoropolymer, and the fluororesin is a fluorcplastic but not a fluoroelastamer. The fluororesin has a melting point and has thermoplasticity. For example, the fluororesin may be melt-fabricable or may be non melt-processible, but the fluororesin is preferably melt-fabricable, since a covered wire can be made by melt extrusion molding, and a covered wire and a twisted wire can be manufactured with high productivity.

As the fluoropolymer, a perfluoropolymer is preferable, since flame retardancy thereof is excellent, a further reduction in weight is allowed, and other electrical properties thereof are also good. In the present disclosure, the perfluoropolymer is a polymer in which all monovalent atoms bonded to carbon atoms constituting a polymer main chain are fluorine atoms. However, besides monovalent atoms (fluorine atoms), an atomic group such as an alkyl group, a fluoroalkyl group, an alkoxy group, a fluoroalkoxy group and the like may be bonded to carbon atoms constituting a polymer main chain, for example. In sane embodiments, same of the fluorine atoms bonded to carbon atoms constituting a polymer main chain are substituted by chlorine atoms. In sane embodiments, an atom other than the fluorine atoms is present in a polymer end group (i.e. a group terminating a polymer chain). The polymer end group is often an atomic group derived from a polymerization initiator or a chain transfer agent which is used for a polymerization reaction.

In the present disclosure, the term "melt-fabricable" means that a polymer can be melted and fabricated by using a conventional processing device such as an extruder and an injection molding device. Accordingly, the melt-fabricable fluororesin usually has a melt flow rate measured by the measurement method described later of 0.01 to 500 g per 10 minutes.

Examples of the melt-fabricable fluororesin include a tetrafluoroethylene (TFE)/hexafluoropropylene (HFP)-based copolymer, a TFE/perfluoro (alkylvinylether) (PAVE) copolymer, a TEE/ethylene-based copolymer [ETFE], a chlorotrifluoroethylene (CTFE)/ethylene copolymer [ECTFE], a polyvinylidene fluoride [PVdF], a polychlorotrifluoroethylene [PCTFE], a TFE/vinylidene fluoride (VdF) copolymer [VT], a polyvinyl fluoride [PVF], a TFE/VdF/CTFE copolymer [VTC], a TFE/ethylene/HFP copolymer and a TFE/HFP/VdF copolymer.

Examples of the PAVE include a perfluoro(methyl vinyl ether) (PVE), a perfluoro(ethyl vinyl ether)(PEVE) and a perfluoro(propyl vinyl ether) (PPVE). Among them, a PPVE is preferable. One or two or more of these can be used.

In sane embodiments, the fluororesin has a polymerization unit based on another monomer in an amount range not impairing essential properties of an individual fluororesin. Said another monomer can be appropriately selected from TFE, HFP, ethylene, propylene, a perfluoro(alkyl vinyl ether), a perfluoroalkylethylene, a hydrofluoroolefin, a fluoroalkylethylene, a perfluoro(alkyl allyl ether) and the like, for example.

The fluororesin is preferably at least one selected from the group consisting of TFE/HFP-based copolymers, TFE/PAVE copolymers and TEE/ethylene-based copolymers, and the fluororesin is more preferably at least one selected from the group consisting of TEE/HFP-based copolymers and TEE/PAVE copolymers, as these copolymers have excellent heat resistance. In addition, perfluororesin is also preferable, since perfluororesin has more excellent electrical properties. In the present disclosure, the perfluororesin is resin including a perfluoropolymer described above.

The TEE/HFP-based copolymer preferably has a TEE/HFP mass ratio of 80 to 97/3 to 20, with a mass ratio of 84 to 92/8 to 16 being more preferable.

In same embodiments, the TEE/HFP-based copolymer is a binary copolymer including TFE and HFP. Alternatively, the TFE/HFP-based copolymer may be a ternary copolymer further including a comonomer copolymerizable with TEE and HFP (for example, a TEE/HFP/PAVE copolymer).

It is also preferable that the TEE/HFP-based copolymer is a TEE/HFP/PAVE copolymer including a polymerization unit based on PAVE.

The TEE/HFP/PAVE copolymer preferably has a TEE/HFP/PAVE mass ratio of 70 to 97/3 to 20/0.1 to 10, with a mass ratio of 81 to 92/5 to 16/0.3 to 5 being more preferable.

The TEE/PAVE copolymer preferably has a TEE/PAVE mass ratio of 90 to 99/1 to 10, with a mass ratio of 92 to 97/3 to 8 being more preferable.

The TEE/ethylene-based copolymer preferably has a TEE/ethylene molar ratio of 20 to 80/20 to 80, with a molar ratio of 40 to 65/35 to 60 being more preferable. In addition, in sane embodiments, the TEE/ethylene-based copolymer contains another monomer component.

That is, the TEE/ethylene-based copolymer may be a binary copolymer including TEE and ethylene, and the TEE/ethylene-based copolymer may be a ternary copolymer further including a commoner copolymerizable with TEE and ethylene (for example, a TFE/ethylene/HFP copolymer), for example.

It is also preferable that the TEE/ethylene-based copolymer is a TEE/ethylene/HFP copolymer including a polymerization unit based on HFP. The TEE/ethylene/HFP copolymer preferably has a TEE/ethylene/HFP molar ratio of 40 to 65/30 to 60/0.5 to 20, with a molar ratio of 40 to 65/30 to 60/0.5 to 10 being more preferable.

The melt flow rate (MFR) of the fluororesin is preferably 0.1 to 100 g per 10 minutes, more preferably 4 to 70 g per 10 minutes, still more preferably 19 to 60 g per 10 minutes, especially preferably 34 to 50 g per 10 minutes, and most preferably 34 to 42 g per 10 minutes. As the MFR becomes lower, the reduction in weight of an insulated wire tends to be easier, and as the MFR becomes higher, the manufacturing of an insulated wire tends to be easier.

The MFR described above is a value measured using a die with a diameter of 2.1 mm and a length of 8 mm at a load of 5 kg at 372° C. according to ASTM D-1238.

The fluoropolymer can be synthesized by polymerizing a monomer component using a typical polymerization method such as emulsion polymerization, suspension polymerization, solution polymerization, bulk polymerization, vapor phase polymerization and the like. In the above polymerization reactions, a chain transfer agent such as methanol is optionally used. For example, the fluoropolymer may be manufactured through polymerization and isolation without using a metal ion-containing reagent.

For example, the fluoropolymer may have an end group such as —$CF_3$ and $CF_2H$ at a site of at least one of its polymer main chain and a polymer side chain. The fluoropolymer is not limited but is preferably subjected to fluorination treatment. A fluoropolymer without fluorination treatment optionally has a thermally and electrically unstable end group (hereinafter, such an end group is also referred to as an "unstable end group") such as —COOH, —$CH_2H$, —COF, —$CONH_2$. Such an unstable end group can be reduced by the fluorination treatment described above.

Preferably, the fluoropolymer includes a few or no unstable end group described above, and it is more preferable that the total number of the above 4 types of the unstable end groups and —$CF_2H$ end groups is 50 or less per $1\times10^6$ carbon atoms. When the total number exceeds 50, molding failure may occur. The number of the above unstable end groups is preferably 20 or less and more preferably 10 or less. In the present specification, the number of the above unstable end groups is a value obtained from infrared absorption spectrum measurement. In same embodiments, neither the above unstable end group nor —$CF_2H$ end group is present and all end groups are —$CF_3$ end groups.

The above fluorination treatment can be performed by bringing a fluoropolymer not having been subjected to fluorination treatment into contact with a fluorine-containing compound.

The above fluorine-containing compound is not limited but examples thereof include a fluorine-radical source generating a fluorine radical under a fluorination treatment condition. Example of the fluorine-radical source include $F_2$ gas, $CoF_3$, $AgF_2$, $UF_6$, $OF_2$, $N_2F_2$, $CF_3F$, a halogen fluoride (for example, $IF_5$, $ClF_3$).

For example, the concentration of the above fluorine-radical source such as $F_2$ gas may be 100%, but the fluorine-radical source is preferably used after being combined with inert gas to be diluted by 5 to 50% by mass, preferably by 15 to 30% by mass in view of the safety aspect. Examples of the above inert gas include nitrogen gas, helium gas and argon gas, but nitrogen gas is preferable in view of the economical aspect.

The above fluorination treatment condition is not limited, and the fluoropolymer in a melted state may be brought into contact with the fluorine-containing compound, for example. However, the fluorination treatment can be usually performed at a temperature equal to or less than a melting point of the fluoropolymer, preferably at 20 to 220° C. and more preferably at 100 to 200° C. The above fluorination treatment is generally performed for 1 to 30 hours, preferably 5 to 20 hours.

Preferably, a fluoropolymer not having been subjected to fluorination treatment is brought into contact with fluorine gas ($F_2$ gas) in the above fluorination treatment.

In some embodiments, the insulator further includes a thermoplastic resin other than the fluoropolymer. Examples of the thermoplastic resin other than the fluoropolymer include a general-purpose resin such as a polyethylene resin, a polypropylene resin, a vinyl chloride resin, a polystyrene resin; and engineering plastic such as nylon, polycarbonate, a polyetheretherketone resin, a polyphenylene sulfide resin.

In some embodiments, the insulator includes a conventional well-known filler in a range not impairing the effect which the present disclosure aims at in addition to the fluoropolymer.

Examples of the filler include graphite, carbon fiber, coke, silica, zinc oxide, magnesium oxide, tin oxide, antimony oxide, calcium carbonate, magnesium carbonate, glass, talc, mica, mica, aluminum nitride, calcium phosphate, seriate, diatomaceous earth, silicon nitride, fine silica, alumina, zirconia, quartz powder, kaolin, bentonite and titanium oxide. The shape of the above filler is not limited and examples thereof include fibrous, acicular, powdery, granular and bead-like shapes.

In some embodiments, the insulator further contains another component such as an additive. Examples of the another component include a filler such as glass fiber, glass powder and asbestos fiber, a reinforcing agent, a stabilizer, a lubricant, a pigment, and another additive.

The insulator may have a single layer structure or a multi-layered structure, for example. However, the insulator preferably has a single layer structure in the light of easiness in molding processes of the wire, and it is more preferable that the insulator has a single layer structure including a fluoropolymer, since flame retardancy thereof is excellent, a further reduction in weight is allowed, and other electrical properties thereof are also good. Examples of the multi-layered structure include a double-layered structure including an inner layer and an outer layer, wherein the inner layer includes a non-fluorinated polymer such as a polyolefin, and the outer layer is provided around the inner layer and includes a fluoropolymer such as a TEE/HFP-based copolymer; a double-layered structure including an inner layer and an outer layer, wherein the inner layer includes a fluoropolymer such as a TFE/HFP-based copolymer, and the outer layer is provided around the inner layer and includes a fluoropolymer such as a TFE/HFP-based copolymer and the like. Examples of the polyolefin forming the inner layer include a flame retardant polyolefin. In addition, an insulator having a double-layered structure in which both inner and outer layers include fluoropolymers is preferable, since mechanical properties of the insulator can be adjusted while keeping excellent flame retardancy of the fluoropolymers. The types of the fluoropolymers for the inner and outer layers may be the same or different, for example. A thickness ratio (inner layer/outer layer) between the inner layer and the outer layer forming the double-layered structure may be 30/70 to 70/30, for example.

A dielectric constant of the insulator at 6 GHz is preferably 2.3 or less and more preferably 2.1 or less, and may be 1.9 or more, for example. A dielectric constant of the insulator within the above range provides a high transmission efficiency.

A dielectric tangent of the insulator at 6 GHz is preferably $5.0\times10^{-3}$ or less, more preferably $1.4\times10^{-3}$ or less, still more preferably $7.0\times10^{-4}$ or less, especially preferably $4.5\times10^{-4}$ or less, most preferably $4.0\times10^{-4}$ or less, preferably $2.5\times10^{-4}$ or more and more preferably $2.8\times10^{-4}$ or more. A dielectric tangent of the insulator within the above range provides a high transmission efficiency.

The dielectric constant and dielectric tangent in the present disclosure are values obtained by measurement under a temperature of 20 to 25° C. using a network analyzer (manufactured by Kanto Electronics Application and Development Inc.) with cavity resonator perturbation method.

The twisted wire of the present disclosure is suitably adopted as an insulated wire for communication. Examples of the insulated wire for communication include cables for connecting a computer and its peripheral equipment such as a cable for data transmission like a cable for LAN, for example. The twisted wire of the present disclosure is also suitable for a plenum cable wired in an attic space (plenum area) of a building or the like, for example.

An insulated wire for communication can also be made by bundling a plurality of twisted wires of the present disclosure. For example, the insulated wire for communication includes 4 twisted wires of the present disclosure and a jacket covering the twisted wires. A higher transmission efficiency is obtained by changing the pitch length of each of the twisted wires.

(Manufacturing Method of Twisted Wire)

The twisted wire of the present disclosure can be manufactured by a manufacturing method including a cooling step of cooling a plurality of covered wires each including a conductor and an insulator covering the periphery of the conductor to 5° C. or lower, and a twisting step of twisting the plurality of covered wires together. The manufacturing method of a twisted wire of the present disclosure does not need to form an insulator having a complex shape and can manufacture a light twisted wire having a characteristic impedance similar to a designed characteristic impedance without using a special extruder.

Figure 3:
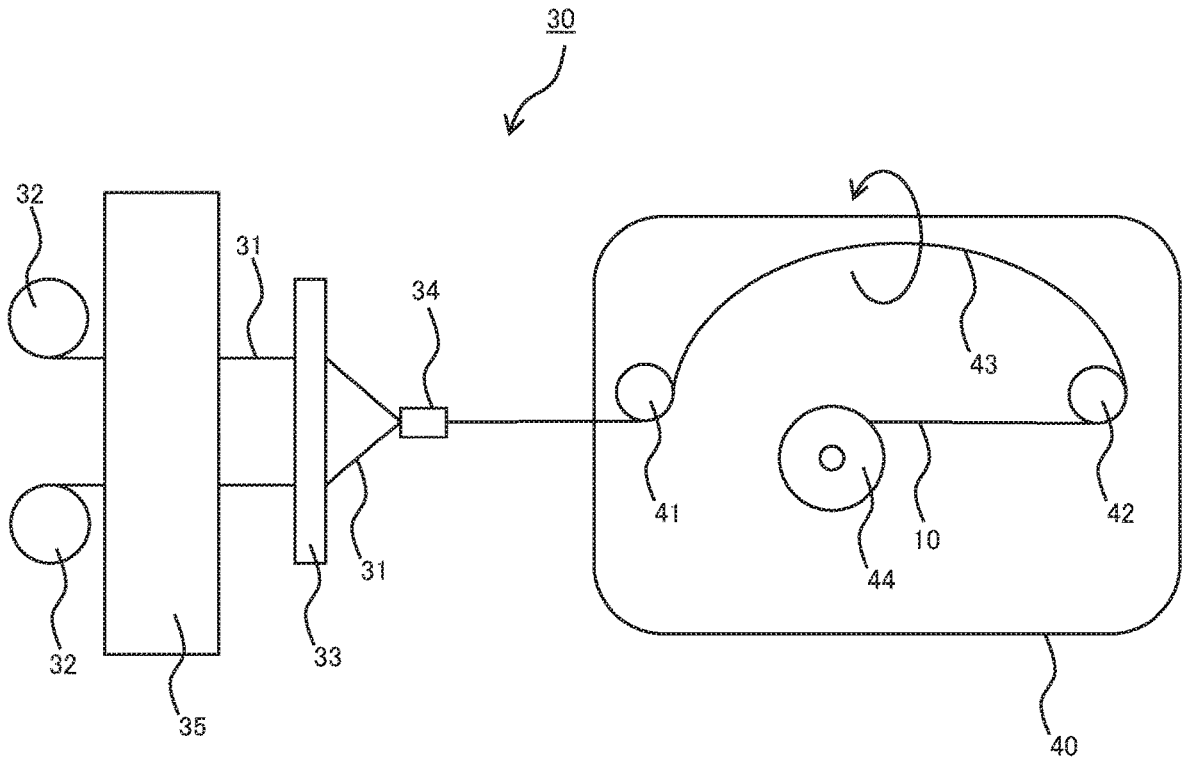
FIG. 3 is a diagram showing an entire configuration of a twisted wire manufacturing device according to one embodiment for manufacturing a twisted wire of the present disclosure.

FIG. 3 is a diagram showing an entire configuration of a twisted wire manufacturing device 30 according to one embodiment for manufacturing the twisted wire of the present disclosure. As shown in FIG. 3, the twisted wire manufacturing device 30 according to one embodiment of the present disclosure includes a covered wire drum 32 around which a covered wire 31 is wound, a wiring board 33 including holes (not shown) which are provided on the same circumference and through each of which a covered wire 31 is inserted, a wire concentration port 34 for assembling a plurality of (in this example, two) covered wires 31, and a wire twisting machine 40 twisting and winding up the covered wires 31. The twisted wire manufacturing device 30 further includes cooling means 35. The wire twisting machine 40 is a wire twisting machine of double twist buncher type including guide rollers 41 and 42, an arcate rotating part 43 and an end drum 44. As shown in FIG. 3, the covered wire 31 is sent from the covered wire drum 32 to the wire twisting machine 40 via the wiring board 33 and wire concentration port 34, and the covered wires 31 are twisted by the wire twisting machine 40 to form a twisted wire 10. As shown in FIG. 3, in the wire twisting machine 40, the guide rollers 41 and 42 and the arcate rotating part 43 synchronously rotate, and torsion is applied to the covered wires 31 during the process from the wire concentration port 34 to the guide roller 41. Then, the torsion is further applied to the covered wires 31 during the process from the guide roller 42 positioned at a downstream side to the end drum 44. Finally, the obtained twisted wire 10 is wound around the end drum 44.

Then, in the manufacturing device 30 shown in FIG. 3, the cooling means 35 is provided between the covered wire drum 32 and the wiring board 33. The respective covered wires 31 sent from the covered wire drums 32 are cooled to a predetermined temperature (cooling step) by the cooling means 35 and subsequently twisted together by the wire twisting machine 40 (twisting step).

In the cooling step, all of the plurality of covered wires are cooled to 5° C. or lower. The cooling temperature in the cooling step is preferably 0° C. or lower and more preferably −40° C. or lower. From a viewpoint of allowing a further reduction in weight, a lower cooling temperature is preferable, but from a viewpoint of cost, a preferable lower limit of the cooling temperature can be set at −20° C. or higher. In addition, in the cooling step, it is preferable that the covered wires are cooled so as to be 5° C. or lower, more preferably the covered wires are cooled so as to be 0° C. or lower, and still more preferably the covered wires are cooled so as to be −40° C. or lower when the covered wires are twisted together. In addition, in same embodiments, the covered wires are cooled so that a temperature thereof becomes −20° C. or higher when the covered wires are twisted together.

Since the plurality of wires having been subjected to the cooling step and cooled are twisted together, the covered wires are twisted together without the occurrence of great collapse in the insulator. The twisted wire obtained in this manner has a distance between centers of conductors not much different than a designed distance between centers of conductors, hence the twisted wire has a characteristic impedance similar to a designed characteristic impedance. That is, according to the manufacturing method of a twisted wire of the present disclosure, a twisted wire showing a characteristic impedance closer to a designed value can be easily manufactured as compared to a conventional twisted wire with the same pitch length. Further, a lighter twisted wire can be manufactured as compared to a conventional twisted wire with the same pitch length and characteristic impedance.

In FIG. 3, while the covered wire 31 is cooled during the process from the covered wire drum 32 to the wiring board 33, the cooling position is not limited as long as the covered wire 31 is sufficiently cooled at the position when the covered wires 31 are twisted together. For example, in some embodiments, the cooling means is provided to cool the covered wire 31 wound around the covered wire drum 32, or the cooling means is provided to cool the covered wire 31 positioned at the wiring board 33 or the wire concentration port 34.

The cooling means 35 is not limited as long as it can cool the covered wire 31 to a desired temperature, but examples thereof include a method for bringing the covered wire 31 into contact with cool air; a method for bringing the covered wire 31 into contact with a cooling liquid; a method for bringing the covered wire 31 into contact with the covered wire drum 32, wiring board 33 or wire concentration port 34 having been cooled; a method for bringing the covered wire 31 into contact with a cooling roll (not shown) and the like.

Examples of the method for bringing the covered wire 31 into contact with cool air include a method for blowing the covered wire 31 with cool air, a method for allowing the covered wire 31 to pass through inside of a chamber with an atmospheric temperature thereof having been cooled. Any chamber is used as the "chamber" in this case regardless of its form, type and size as long as the chamber allows the covered wire 31 to pass therethrough. This "chamber" can be referred to as a cooling tank, a cooling division, a cooling container or the like. Specifically, a freezer and a thermostatic bath as well as an environmental testing machine are possible.

In addition, the covered wire 31 can also be cooled by a method for controlling the temperature of an atmosphere (environment) in which the twisted wire manufacturing device 30 is placed to a predetermined temperature. In this case, a temperature of a roan or booth where the twisted wire manufacturing device 30 is placed may be controlled, or the twisted wire manufacturing device 30 may be housed in a cabinet, case, enclosure, housing or the like and the temperature inside thereof may be controlled, for example.

Examples of the means for cooling an atmosphere can include a heat exchanger, and examples of a refrigerant used for the heat exchanger include fluorocarbon and a brine solution. In addition, cool air produced by the heat exchanger or gas obtained by vaporizing a solid body or liquid having a vaporizing temperature of 0° C. or lower (for example, dry ice or liquid nitrogen) can be used as the cool air. In addition, cool air may be blown into a cabinet, case, enclosure, housing or the like in which the twisted wire manufacturing device is housed, for example. It is also preferable that possible dew condensation occurring on or in the covered wire, wire twisting machine and the like is prevented by cool air. The dew condensation can be prevented by using cool air having been dehumidified, for example.

Examples of the cooling liquid include a liquid having a freezing point of 0° C. or lower and include acetone having been cooled by liquid nitrogen or dry ice.

The position at which the covered wire 31 is brought into contact with the cool air or cooling liquid is not limited as described above, and in same embodiments, the covered wire 31 wound around the covered wire drum 32 is brought into contact with the cool air or cooling liquid, or the covered wire 31 positioned at anywhere between the covered wire drum 32 and the wire concentration port 34 is brought into contact with the cool air or cooling liquid, for example.

Examples of the method for cooling the covered wire drum 32, wiring board 33, wire concentration port 34 or cooling roll include a method using a heat exchanger and a method using a refrigerant.

The covered wire used in the manufacturing method of a twisted wire of the present disclosure can be made by a well-known method. For example, the covered wire including a conductor and an insulator covering the periphery of the conductor can be made by extruding a polymer on the conductor using extrusion molding. Especially, the covered wire is preferably made by melt extrusion molding in view of excellent productivity.

While various embodiments have been described herein above, it is to be appreciated that various changes in form and detail may be made without departing from the spirit and scope presently or hereafter claimed.

EXAMPLES

Next, embodiments of the present disclosure are described with Examples, but the present disclosure is not limited to the Examples.

Every value in the examples was measured by the following methods.

(Collapsing Rate)

One of the covered wires constituting the twisted wire obtained in Examples and Comparative Examples is cut by a nipper without damaging and deforming the other wire to render the wire a single wire state. The covered wire processed into a single wire is allowed to stand vertically to an X-ray source of an X-ray CT scanner (manufactured by Toshiba IT & Control Systems Corporation, TOSCANER-30900 $\mu C^3$) in which a tube voltage and tube current are respectively set at 90 kV and 55 μA, and X-ray is irradiated thereto while rotating the covered wire 360° to obtain a cross-sectional image of the covered wire. When the obtained image is distorted, the image is deformed so that the copper wire becomes a true circle, and an external profile of the outermost layer at that time is drawn as a true circle based on the covered part which does not collapse. In a case where a true circle cannot possibly be achieved, correction with an ellipse is optionally made. A diameter of the external profile of the outermost layer is drawn so that the diameter passes through the center of the collapsed face, and the distance from the external profile to the collapsed face is calculated from the intersection with the collapsed face.

The collapsing rate can be calculated by the expression: (Distance from External Profile to Collapsed Face)/(Diameter of External Profile)×100(%).

(Elastic Modulus)

The insulator was picked up from the covered wire. A sheet having a thickness of 1 to 2 m was prepared by compression molding the picked up insulator at a molding temperature 50° C. higher than the melting point of a material forming the insulator and a molding pressure of 3 MPa, and a specimen was prepared according to ASTM D638 using the obtained sheet. A tensile test was performed on the prepared specimen at a speed of 100 mm/min. using TENSILON universal testing machine to obtain a tensile modulus of elasticity.

(Dielectric Constant and Dielectric Tangent)

Melt extrusion was performed at 280° C. using fluoropolymers used in Examples and Comparative Examples to prepare columnar measurement samples with 2.3 mm diameter×80 mm length. Dielectric constants and dielectric tangents at 6.0 GHz were measured on these measurement samples using a network analyzer (manufactured by Kanto Electronics Application and Development Inc.) with cavity resonator perturbation method (test temperature: 25° C.).

(Constant A and Constant B)

The pitch length and collapsing rate values of the twisted wires obtained in Examples and Comparative Examples were plotted on a graph in which the horizontal axis represents pitch lengths of twisted wires and the vertical axis represents collapsing rates of twisted wires, and a straight line defining the boundary between Examples and Comparative Examples was drawn, Constant A was obtained from the slope of the drawn line, and Constant B was obtained from the intersection with the vertical axis.

(Composition of Fluoropolymer)

The mass ratio of each polymerization unit of a fluoropolymer was obtained by measuring the content rate of each of the polymerization units using, for example, an NMR analyzer (for example, AC300 high temperature prove, manufactured by Bruker BioSpin GmbH) or an infrared absorption spectrum measuring device (1760 model, manufactured by PerkinElmer, Inc.).

(Melting Point of Fluoropolymer)

A temperature corresponding to a peak obtained by measurement using a differential scanning calorimeter (product name: RDC220, manufactured by Seiko Instruments & Electronics Ltd.) at a temperature-increasing rate of 10° C./min. was taken as a melting point.

(Melt Flow Rate (MFR) of Fluoropolymer)

A value measured by using KAYENESS 4000 Series Melt Indexer (manufactured by YASUDA SEIKI SEISAKUSHO, LTD.) with a die having a diameter of 2.1 mm and a length of 8 mm with a load of 5 kg at 372° C. according to ASTM D-1238 was employed.

Example 1

A covered wire (outside diameter: 1.0 am, diameter of copper wire: 0.510 am, insulator thickness: 0.245 am) including a copper wire and an insulator of TFE/HFP/PPVE copolymer A (TFE/HFP/PPVE (mass ratio): 87.5/11.5/1.0, melting point: 257° C., MFR: 36.3 g/10 min., elastic modulus: 460 MPa, dielectric constant (εr) at 6 GHz: 2.05, dielectric tangent at 6 GHz: 3.3×10-) which was formed around the copper wire by melt extrusion molding was set in a thermostatic bath (manufactured by ESPEC CORP., model number: SH-241) set at 0° C. and was left until the temperature of the wire became the atmospheric temperature of the thermostatic bath (at least 10 minutes).

Two cooled covered wires were twisted together by a twisting machine (manufactured by Tokyo Ideal Co., Ltd., model number: TW-2N) at about 500 tpm so that the pitch lengths described in Table 1 were achieved. The pitch length herein represents a length of one revolution of one wire in a completely twisted part.

Collapsing rates were measured on the obtained twisted pairs (twisted wires) to obtain characteristic impedance (a). Results are shown in Table 1.

(Characteristic Impedance)

The twisted pair is typically designed to have a characteristic impedance of 100 ohms, and the characteristic impedance can be calculated by the following expression with reference to the expression for calculating impedance described in the literature (Brian C. Wadell, "Transmission line design handbook," Artech House on Demand (1991)):

[Expression 4]

$$Z_O = \frac{120}{\sqrt{\varepsilon_{eff}}} \times \ln\left(\frac{D}{d} + \sqrt{\frac{D^2}{d^2} - 1}\right) \quad (3)$$

in Expression (3), $Z_0$: a characteristic impedance, $\varepsilon_{eff}$: an effective dielectric constant calculated by following Expression (4), D: a value (mm) obtained as follows: outside diameter of covered wire (mm)×(1−collapsing rate (%)×2/100), and d: a diameter (mm) of the conductor of covered wire.

$$\varepsilon_{eff}=1.0+q(\varepsilon_r-1.0) \quad (4)$$

In Expression (4), eat: an effective dielectric constant, $\varepsilon_r$: a dielectric constant of the insulator, and q: a correction factor obtained by following Expression (5).

$$q=0.25+0.0004\times(\tan^{-1}(T\pi D))^2 \quad (5)$$

In Expression (5), T: twisting rate (=1 mm/pitch length (mm)), and $\tan^{-1}$ (TπD) is a pitch angle θ(°) of twisting.

If covering is crushed by stress at the time of twisting, a distance between centers of the conductors in the twisted pair becomes short, and the characteristic impedance deviates from a designed value.

Example 2

A twisted pair was prepared in the same manner as in Example 1 except that the set temperature of the thermostatic bath was changed to −40° C. The obtained twisted pair was evaluated in the same manner as in Example 1. Results are shown in Table 1.

Example 3

A twisted pair was prepared in the same manner as in Example 1 except that a covered wire (outside diameter: 1.0 am, diameter of copper wire: 0.510 am, insulator thickness: 0.245 am) including a copper wire and an insulator of TFE/HFP/PPVE copolymer B (TFE/HFP/PPVE (mass ratio): 87.6/11.5/0.9, melting point: 257° C., MFR: 35.7 g/10 min., elastic modulus: 480 MPa, dielectric constant (Br) at 6 GHz: 2.05, dielectric tangent at 6 GHz: $3.3\times10^{-4}$) which was formed around the copper wire by melt extrusion molding was used. The obtained twisted pair was evaluated in the same manner as in Example 1. Results are shown in Table 1.

Example 4

A twisted pair was prepared in the same manner as in Example 3 except that the set temperature of the thermostatic bath was changed to −40° C. The obtained twisted pair was evaluated in the same manner as in Example 1. Results are shown in Table 1.

Comparative Example 1

A twisted pair was prepared in the same manner as in Example 1 except that the set temperature of the thermostatic bath was changed to 20° C. The obtained twisted pair was evaluated in the same manner as in Example 1. Results are shown in Table 1.

Comparative Example 2

A twisted pair was prepared in the same manner as in Example 3 except that the set temperature of the thermostatic bath was changed to 20° C. The obtained twisted pair was evaluated in the same manner as in Example 1. Results are shown in Table 1.

Comparative Example 3

A twisted pair was prepared in the same manner as in Example 1 except that the set temperature of the thermostatic bath was changed to 10° C. The obtained twisted pair was evaluated in the same manner as in Example 1. Results are shown in Table 1.

Reference Example 1

The elastic modulus of an insulator of a twisted pair constituting a plenum cable (manufactured by CommScope, Inc., Ultra 10 10G4 8765 504/10) measured in the same manner as in Example 1 was 427 MPa. In addition, a pitch length and collapsing rate thereof were measured. Results are shown in Table 2.

Reference Example 2

The elastic modulus of an insulator of a twisted pair constituting a plenum cable (manufactured by General Cable, GenSPEED 10MTP Category 6A Cable 7132851) measured in the same manner as in Example 1 was 422 MPa. In addition, a pitch length and collapsing rate thereof were measured. Results are shown in Table 2.

Reference Examples 3 to 6

Four twisted pairs were picked up from a plenum cable (manufactured by Superior Essex Inc., 10Gain Category 6A 6A-272-2B), and the elastic moduli of insulators of the obtained four twisted pairs measured in the same manner as in Example 1 were 450 MPa. In addition, pitch lengths and collapsing rates thereof were measured. Results are shown in Table 2.

TABLE 1

| | Type of Copolymer | Cooling Temperature (° C.) | Pitch Length (mm) | Collapsing Rate (%) | Designed Characteristic Impedance (Ω) | Calculated Characteristic Impedance (Ω) | Difference from Designed Characteristic Impedance |
|---|---|---|---|---|---|---|---|
| Example 1 | A | 0 | 4.8 | 6.2 | 118 | 106 | 12 |
| | | | 5.9 | 4.8 | 123 | 114 | 9 |
| Example 2 | A | −40 | 5.1 | 4.7 | 120 | 111 | 9 |
| | | | 6.3 | 3.5 | 124 | 118 | 6 |
| | | | 7.4 | 2.6 | 127 | 122 | 5 |
| | | | 8.5 | 2.0 | 130 | 125 | 5 |
| Example 3 | B | 0 | 5.8 | 5.0 | 123 | 113 | 10 |
| | | | 7.1 | 3.2 | 127 | 120 | 7 |
| Example 4 | B | −40 | 5.1 | 4.4 | 120 | 112 | 8 |
| | | | 6.4 | 3.1 | 125 | 119 | 6 |
| | | | 7.6 | 2.2 | 128 | 123 | 5 |
| Comparative Example 1 | A | 20 | 4.9 | 8.8 | 119 | 101 | 18 |
| | | | 6.1 | 6.4 | 124 | 110 | 14 |
| | | | 7.3 | 5.9 | 127 | 114 | 13 |
| | | | 8.6 | 4.1 | 130 | 121 | 9 |
| | | | 9.4 | 2.5 | 131 | 126 | 5 |
| | | | 10.3 | 2.1 | 132 | 127 | 5 |
| Comparative Example 2 | B | 20 | 5.1 | 7.3 | 120 | 105 | 15 |
| | | | 6.1 | 5.8 | 124 | 112 | 12 |
| | | | 8.6 | 3.2 | 130 | 123 | 7 |
| | | | 9.6 | 2.6 | 131 | 126 | 5 |
| | | | 10.2 | 2.1 | 132 | 127 | 5 |
| Comparative Example 3 | A | 10 | 4.9 | 8.0 | 119 | 103 | 16 |
| | | | 6.2 | 5.2 | 124 | 114 | 10 |

In the results on Table 1, the twisted wires manufactured through a cooling step in which a covered wire was sufficiently cooled had lower collapsing rates and smaller differences between the designed characteristic impedance and the calculated characteristic impedance than the twisted wires having similar pitch lengths but twisted at 10° C. or higher. Especially, in the twisted wire of Example 1, the difference from the designed characteristic impedance was only 12Ω even if the pitch length of the twisted wire was about 5 rm. In contrast to this, in the twisted wire of Comparative Example 1, when the pitch length was set to about 5 mm, the difference from the designed characteristic impedance reached 18Ω. From the above, it is found that the twisted wire manufactured through a cooling step in which a covered wire is sufficiently cooled has a characteristic impedance not much different than a designed characteristic impedance.

Next, with respect to the twisted pairs of Examples, Comparative Examples and Reference Examples, values were calculated according to the calculating expression: $A \times x/(z/500)+B$ (wherein x and z are the same as those for Inequality (1), A=−1, B=11.5). Results are shown in Table 2.

In addition, when there is a difference between the designed characteristic impedance and the calculated characteristic impedance, the insulator needs to be thickened, and an amount of polymer forming the insulator needs to be increased to achieve the designed characteristic impedance. The increase in the amount of a polymer for forming an insulator not only causes an increase in manufacturing cost but also causes a twisted wire to get heavy. Therefore, the less the amount of a polymer forming an insulator is, the more preferable. Then, a filling amount (g) per 1000 feet of each polymer required to exhibit an impedance of 100Ω was calculated based on the results described in Table 1. Results are shown in Table 2. Incidentally, the polymer filling amounts (g) were obtained by calculation after unifying conductor diameters and outside diameters by enlarging or reducing the conductor diameters and outside diameters at a rate at which the conductor diameters became 0.573 mm (AWG23) so as to easily compare the twisted pairs with each other. Results are shown in Table 2.

TABLE 2

| | Pitch Length (mm) | Collapsing Rate (%) | $A \times x/(z/500) + B$ | Polymer Filling Amount (g/1000 ft)) |
|---|---|---|---|---|
| Example 1 | 4.8 | 6.2 | 6.3 | 164 |
| | 5.9 | 4.8 | 5.1 | 105 |
| Example 2 | 5.1 | 4.7 | 6.0 | 112 |
| | 6.3 | 3.5 | 4.6 | 71 |
| | 7.4 | 2.6 | 3.5 | 48 |
| | 8.5 | 2.0 | 2.3 | 35 |
| Example 3 | 5.8 | 5.0 | 5.4 | 111 |
| | 7.1 | 3.2 | 4.1 | 63 |
| Example 4 | 5.1 | 4.4 | 6.2 | 105 |
| | 6.4 | 3.1 | 4.8 | 62 |
| | 7.6 | 2.2 | 3.6 | 39 |
| Comparative Example 1 | 4.9 | 8.8 | 6.2 | 253 |
| | 6.1 | 6.4 | 4.9 | 148 |
| | 7.3 | 5.9 | 3.6 | 126 |
| | 8.6 | 4.1 | 2.2 | 77 |
| | 9.4 | 2.5 | 1.2 | 43 |
| | 10.3 | 2.1 | 0.4 | 35 |
| Comparative Example 2 | 5.1 | 7.3 | 6.2 | 192 |
| | 6.1 | 5.8 | 5.2 | 129 |
| | 8.6 | 3.2 | 2.5 | 59 |
| | 9.6 | 2.6 | 1.5 | 45 |
| | 10.2 | 2.1 | 0.8 | 36 |
| Comparative Example 3 | 4.9 | 8.0 | 6.2 | 221 |
| | 6.2 | 5.2 | 4.7 | 113 |
| Reference Example 1 | 6.9 | 4.8 | 3.4 | 95 |
| Reference Example 2 | 7.8 | 4.6 | 2.3 | 89 |
| Reference Example 3 | 8.7 | 3.3 | 1.8 | 60 |
| Reference Example 4 | 8.0 | 4.0 | 2.6 | 76 |
| Reference Example 5 | 7.5 | 4.0 | 3.2 | 78 |
| Reference Example 6 | 9.0 | 3.5 | 1.5 | 64 |

As shown in the results on Table 2, the twisted wires of Examples, which satisfy Inequality (1): $y<A\times x/(z/500)+B$ (wherein x, y and z are as described above, A=−1, B=11.5), have small polymer filling amounts. Accordingly, it is found that even if the characteristic impedance is designed to be 100Ω, a twisted wire satisfying Inequality (1) needs a smaller amount of a polymer forming an insulator as compared to a conventional twisted wire with the same pitch length. That is, a twisted wire satisfying Inequality (1) has a great advantage of not only low manufacturing cost but also light weight.

Figure 4:
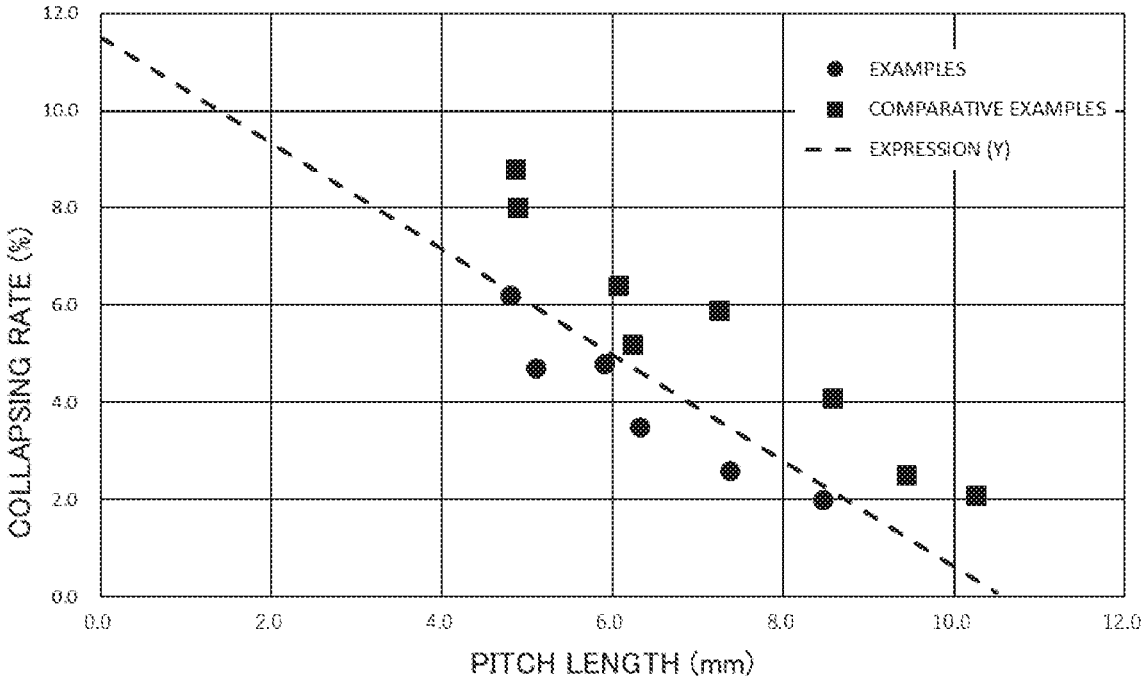
FIG. 4 is a graph on which pitch lengths and collapsing rates of twisted wires of Examples 1 and 2 and Comparative Examples 1 and 3 are plotted.
Figure 5:
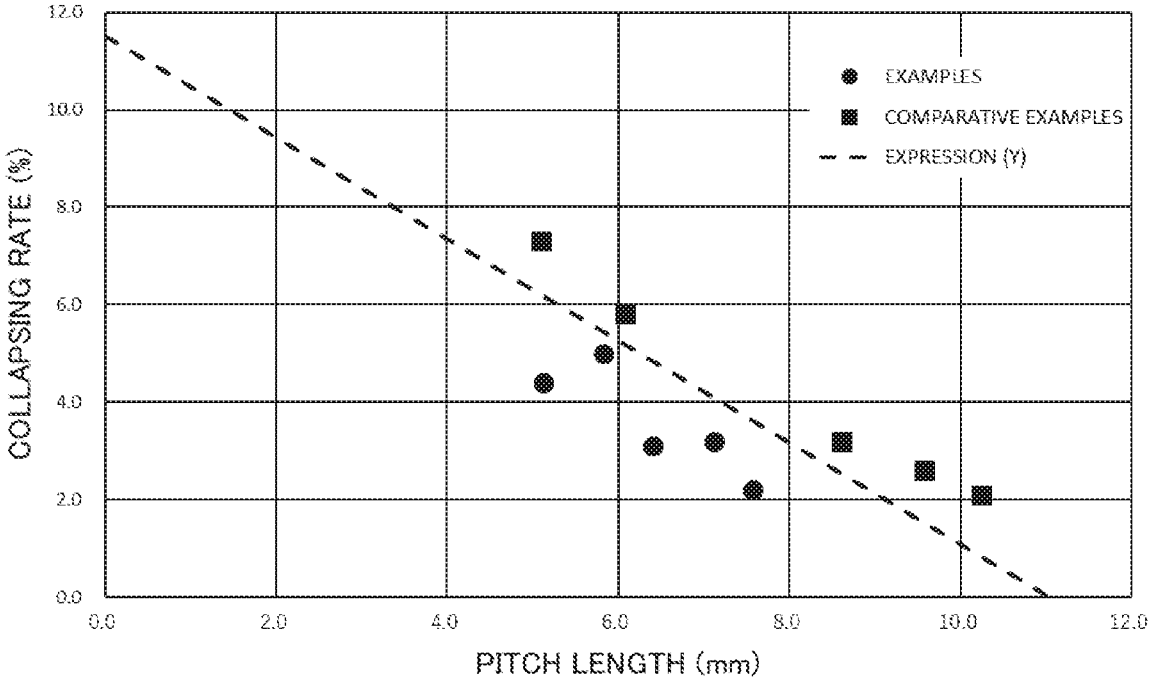
FIG. 5 is a graph on which pitch lengths and collapsing rates of twisted wires of Examples 3 and 4 and Comparative Example 2 are plotted.

A graph on which the pitch lengths and collapsing rates of the twisted wires of Examples 1 and 2 and Comparative Examples 1 and 3 are plotted is shown in FIG. 4. In addition, a graph on which the pitch lengths and collapsing rates of the twisted wires of Examples 3 and 4 and Comparative Example 2 are plotted is shown in FIG. 5. Further, a graph of Expression (Y): $y=A\times x/(z/500)+B$ (wherein x, y and z are the same as those for Inequality (1), A=−1, B=11.5) is shown by a dashed line in each of FIG. 4 and FIG. 5. As shown in FIG. 4 and FIG. 5, the twisted wires satisfying Inequality (1): $y<A\times x/(z/500)+B$ (wherein x, y and z are as described above, A=−1, B=11.5) are twisted wires in which polymer amounts required to achieve a predetermined characteristic impedance are small, and the twisted wires requiring large polymer filling amounts do not satisfy Inequality (1). Accordingly, it is found that a twisted wire satisfying Inequality (1) provides a lighter twisted wire than a conventional wire with the same pitch length.

The present disclosure relates to the following twisted wire and manufacturing method of a twisted wire.

According to the present disclosure, provided is a twisted wire including a plurality of covered wires twisted together, each covered wire including a conductor and an insulator covering the periphery of the conductor, wherein the twisted wire satisfies following Inequality (1):

[Expression 5]

$$y < A \times \frac{x}{z \div 500} + B \quad (1)$$

wherein x: a pitch length (m) of the twisted wire, y: a collapsing rate (%) of the insulator, z: an elastic modulus (MPa) of the insulator, A: Constant A=−1, and B: Constant B=11.5.

In the twisted wire of the present disclosure, the insulator preferably includes a fluoropolymer.

In the twisted wire of the present disclosure, a dielectric constant of the insulator at 6 GHz is preferably 2.3 or less.

In the twisted wire of the present disclosure, a dielectric tangent of the insulator at 6 GHz is preferably $5.0\times10^{-3}$ or less.

In the twisted wire of the present disclosure, a thickness of the insulator is preferably 0.01 to 3.0 am.

In the twisted wire of the present disclosure, the insulator preferably has a single layer structure or a multi-layered structure.

The twisted wire of the present disclosure is preferably a twisted wire in which two covered wires are twisted together.

According to the present disclosure, also provided is a manufacturing method of a twisted wire including a cooling step of cooling a plurality of covered wires each including a conductor and an insulator covering the periphery of the conductor to 5° C. or lower, and a twisting step of twisting the plurality of covered wires together.

In the manufacturing method of a twisted wire of the present disclosure, the plurality of covered wires are preferably cooled to 0° C. or lower in the cooling step.

In the manufacturing method of a twisted wire of the present disclosure, the insulator preferably includes a fluoropolymer.

In the manufacturing method of a twisted wire of the present disclosure, a dielectric constant of the insulator at 6 GHz is preferably 2.3 or less.

In the manufacturing method of a twisted wire of the present disclosure, a dielectric tangent of the insulator at 6 GHz is preferably $5.0\times10^{-3}$ or less.

In the manufacturing method of a twisted wire of the present disclosure, a thickness of the insulator is preferably 0.01 to 3 am.

In the manufacturing method of a twisted wire of the present disclosure, the insulator preferably has a single layer structure or a multi-layered structure.

In the manufacturing method of a twisted wire of the present disclosure, the number of the plurality of covered wires is preferably two.

This application claims priorities to Japanese Patent Applications No. JP2018-084493, No. 2018-104316 and No. 2019-005738, which are incorporated by reference in their entirety.

REFERENCE SIGNS LIST

10 twisted wire
20 covered wire
21 conductor
22 insulator
23 external profile
24 collapsed face
25 diameter line
26, 27 intersection
30 twisted wire manufacturing device
31 covered wire
32 covered wire drum
33 wiring board
34 concentration port
35 cooling means
40 wire twisting machine
41, 42 guide roller
43 arcate rotating part
44 end drum

The invention claimed is:

1. A twisted wire comprising a plurality of covered wires twisted together, each covered wire including a conductor and an insulator covering a periphery of the conductor, wherein the twisted wire satisfies following Inequality (1):

[Expression 6]

$$y < A \times \frac{x}{z \div 500} + B \quad (1)$$

wherein x: a pitch length (mm) of the twisted wire, y: a collapsing rate (%) of the insulator, z: an elastic modulus (MPa) of the insulator, A: Constant A=−1, and B: Constant B=11.5.

2. The twisted wire as claimed in claim 1, wherein the insulator includes a fluoropolymer.

3. The twisted wire as claimed in claim 1, wherein a dielectric constant of the insulator at 6 GHz is 2.3 or less.

4. The twisted wire as claimed in claim 1, wherein a dielectric tangent of the insulator at 6 GHz is $5.0\times10^{-3}$ or less.

5. The twisted wire as claimed in claim 1, wherein a thickness of the insulator is 0.01 to 3.0 mm.

6. The twisted wire as claimed in claim 1, wherein the insulator has a single layer structure or a multi-layered structure.

7. The twisted wire as claimed in claim 1, wherein two covered wires are twisted together.

8. A manufacturing method of a twisted wire, comprising: cooling a plurality of covered wires each including a conductor and an insulator covering a periphery of the conductor to 5° C. or lower; and twisting the plurality of covered wires together.

9. The manufacturing method of a twisted wire as claimed in claim 8, which comprises cooling the plurality of covered wires to 0° C. or lower.

10. The manufacturing method of a twisted wire as claimed in claim 8, wherein the insulator includes a fluoropolymer.

11. The manufacturing method of a twisted wire as claimed in claim 8, wherein a dielectric constant of the insulator at 6 GHz is 2.3 or less.

12. The manufacturing method of a twisted wire as claimed in claim 8, wherein a dielectric tangent of the insulator at 6 GHz is $5.0\times10^{-3}$ or less.

13. The manufacturing method of a twisted wire as claimed in claim 8, wherein a thickness of the insulator is 0.01 to 3 mm.

14. The manufacturing method of a twisted wire as claimed in claim 8, wherein the insulator has a single layer structure or a multi-layered structure.

15. The manufacturing method of a twisted wire as claimed in claim 8, wherein the number of the plurality of covered wires is 2.

* * * * *